US006490878B1

(12) United States Patent
Luminet et al.

(10) Patent No.: US 6,490,878 B1
(45) Date of Patent: Dec. 10, 2002

(54) COLD SALES CABINET

(76) Inventors: Philippe Luminet, 43, rue Colin, 69100 Villeurbanne (FR); Bernard Teissedre, 162, Boulevard Berthier, 75017 Paris (FR); Michel Corfec, 15, rue Aubier, 41200 Villefranche-sur-Cher (FR); Denis Consigny, 44, rue de Beaumont, 95290 L'Isle-Adam (FR)

( * ) Notice: Subject to any disclaimer, the term of this patent is extended or adjusted under 35 U.S.C. 154(b) by 0 days.

(21) Appl. No.: 09/857,693

(22) PCT Filed: Dec. 7, 1999

(86) PCT No.: PCT/FR99/03034

§ 371 (c)(1),
(2), (4) Date: Sep. 10, 2001

(87) PCT Pub. No.: WO00/33707

PCT Pub. Date: Jun. 15, 2000

(30) Foreign Application Priority Data

Dec. 9, 1998 (FR) ..... 98 16077

(51) Int. Cl.[7] ..... A47F 3/04
(52) U.S. Cl. ..... 62/256; 62/256
(58) Field of Search ..... 62/255, 256, 78

(56) References Cited

U.S. PATENT DOCUMENTS 5,590,541 A * 1/1997 Rainwater ..... 62/255
5,722,245 A * 3/1998 Ponder ..... 165/231

FOREIGN PATENT DOCUMENTS

GB 2278668 * 12/1994 ..... F25D/21/06

* cited by examiner

*Primary Examiner*—Harry B. Tanner
*Assistant Examiner*—Mohammad M. Ali
(74) *Attorney, Agent, or Firm*—Sughrue Mion, PLLC

(57) ABSTRACT

The invention relates to a cold sales cabinet for conserving foodstuffs. It applies to cabinets having means for circulating a flow of air and associated with an internal or an external refrigeration unit. A cold sales cabinet of the invention is characterized in particular in that it comprises at least one enclosure (12) containing an evaporator (2), said enclosure being provided with microwave energy transmission means (10) and presenting two opposite walls (15, 16) that are proof against microwave radiation and not airtight. The microwave radiation is used to limit quickly and cheaply phenomena of frosting or icing on the evaporator (2) so as to improve refrigeration performance.

12 Claims, 3 Drawing Sheets

COLD SALES CABINET

The present invention relates to a device for simultaneously improving the performance of cabinets, windows, counters, chests, stalls, or units for displaying and selling foodstuffs that are conserved at a temperature lower than ambient temperature. Refrigerated or deep-freeze cabinets are in very widespread use in stores for dispensing foodstuffs, in pharmaceutical outlets, or more generally whenever it is necessary to conserve goods at a temperature lower than ambient. In the text below, refrigerated or deep-freeze cabinets, windows, counters, chests, stalls, or units are referred to generically as "cold sales cabinets".

In the present state of the art, refrigerated cabinets, windows, or counters, and more particularly so-called "open" cabinets, all present the feature of operating by virtue of curtains of refrigerated air subjected to forced circulation along the open face. Said open face can be horizontal or vertical. Whatever the precautions taken to guide such curtains of air, it is found that some mixing takes place between the refrigerated air and the air of the premises in which said cabinets are placed. A consequence of this partial mixing is that a significant quantity of water vapor is contained in the flow of air driven by the fans and put into thermal contact with the evaporator of a cold sales cabinet. This water vapor is inevitably trapped at said evaporator where it becomes deposited as a progressive buildup of ice. This buildup of ice has the effect of progressively constituting an insulating sheath around the evaporator and its fins, thereby reducing the heat exchange coefficient between said element and the circulating air, and also increasing head losses, thereby significantly reducing the flow rate of refrigerated air.

After cold sales cabinets have been in operation for a few tens of minutes (which period is a function of the humidity of the ambient air, the dew point temperature, and the evaporation temperature of the refrigerating fluid), a significant drop is observed in the efficiency of the curtain of air, and consequently a rise is observed in the temperature of the inside of the cabinet and of the foodstuffs it contains.

To combat that phenomenon of frost appearing and the associated losses of performance, various solutions have been proposed which have turned out to be relatively unsatisfactory.

Firstly, it has been proposed to warm up the evaporator periodically, either by stopping the circulation of refrigerating fluid within said component, or by providing it with heater cords or electric resistances, or indeed by heating the air (WO 98/06987 to Hislop, FR-2 610 708 to Bosch Siemens, EP-0 768 053 to Sanyo, EP-0 403 459 to Electrolux).

Proposals have also been made to duplicate the evaporator, with one of the elements being defrosted while the other one is in operation (WO 94/26154 to Hussmann).

Proposals have also been made to dehumidify the air prior to passing over it over the evaporator (application No. 91/09664 - 2 679 988 to A.R.M.I.N.E.S.).

Proposals have also been made to build up a store of low temperature, using a large mass of ice or a eutectic for the purpose of taking over from the evaporator for the length of time it requires to be defrosted (application No. 88/02314 - 2 611 383 to Toshiba).

Finally, numerous dispositions and combinations of single, double, or triple air curtains have been proposed in which said air curtains are either heated or cooled for the dual purposes of limiting uptake of water vapor in the flow of air and limiting condensation on the evaporator (WO 97/17003 to Bonnet Neve, EP-0 709 046 to Sanyo, FR-2 615 082 to Bonnet Refrigeration, WO 94/23620 to Northampton Refrigeration).

Proposals have also been made to defrost the evaporator by using jets of superheated gas or steam.

None of those solutions turns out to be genuinely satisfactory, whether from the point of view of the energy consumption of cold sales cabinets or the genuine performance of such apparatuses and their ability to keep foodstuffs under temperature conditions that comply fully with the legislation in force.

In terms of cost, it is found that the need to combat frosting phenomena on evaporators leads to evaporators, fans, and air circuits being over-dimensioned. The length and the frequency of the essential defrosting cycles in presently-available apparatuses are such that these pieces of equipment are used for their refrigeration function during less than 80% of their total operating time. The remainder of the time they are used for a function that is the exact opposite from that for which they are designed, i.e. to be subjected to or to cause heating which temporarily and partially cancels their effects. Experience shows that presently-manufactured and sold cold sales cabinets are subjected to large temperature variations over time, which makes it very difficult to comply with the standards in force; these variations are particularly large between the beginning and the end of the defrosting period, which period inevitably gives rise, in the present state of the art, to significant heating of the air curtain and thus of the foodstuffs. Experience also shows that in the present state of the art and regardless of the particular solution implemented to combat evaporator frosting phenomena, presently-manufactured and sold cold sales cabinets cannot provide a temperature that is uniform throughout their inside volume: the phenomenon of evaporator frosting does not take place identically on all parts of said element, so the resulting head losses are necessarily non-uniform, and as a result the temperature and the flow rate of the air curtain(s) are themselves non-uniform. This state of affairs leads to certain inside portions of the cabinet being at a temperature that is far from its nominal temperature, and that is prejudicial to good conservation of foodstuffs.

It is also observed in the present state of the art that evaporators and elements situated close to evaporators in cold sales cabinets can be the subject of microbial or bacterial proliferation phenomena, with pockets of air or collections of water warmed by the action of the defrosting means presently in use providing media that encourage the development of germs, bacteria, or microbes. Since, by construction, these evaporators and their immediate vicinity are difficult to access with any kind of cleaning or decontamination means, it is unfortunately observed that these organisms can become transferred to the foodstuffs or goods conserved inside cold sales cabinets, with the vector being air which is circulated by the fans.

That said, non-published experiments performed by the authors of the present application concerning cold sales cabinets fitted with defrosting devices included in the prior art have shown that the formation of frost on the outside surfaces of evaporators does not have a totally negative effect on the performance of such cabinets: it is found that initially the appearance of a thin film of frost on the outside surface of an evaporator has the effect of increasing its real heat exchange area and thus of increasing heat exchange efficiency to a significant extent; this applies in particular when the layer of frost covering the outside surfaces of the evaporator is of a thickness that does not exceed 1 millimeter (mm). After a few minutes of operation, this positive effect is overtaken by the negative effect of the insulation caused by depositing a layer of frost and/or ice having a thickness of several millimeters; thereafter, this layer of frost and/or ice creates an obstruction, and then a complete blockage between the fins of the evaporator, which ends up by preventing all air circulation and thus preventing any heat exchange.

The invention proposes means for taking advantage of the positive effects of the appearance of frost on the surface of the evaporator and for eliminating the negative effects of said phenomenon.

More generally, the invention proposes making cold sales cabinets that mitigate all of the drawbacks described above.

An object of the invention is to provide a cold sales cabinet capable of ensuring that all of the foodstuffs it contains has a temperature that is constant in time and uniform in space.

Another object of the invention is to propose a cold sales cabinet having better energy efficiency, i.e. consuming less energy for a given level of performance.

An additional object of the invention is to make it possible to provide a cold sales cabinet of a cost price that is significantly reduced, which result is obtained by optimizing elements such as the evaporator and the fans which can operate in regular manner for up to 100% of the time, and as a result can be smaller in size than those presently used in cabinets seeking to provide performance at the same level as that provided by a cold sales cabinet of the invention.

Another additional object of the invention is to propose a cold sales cabinet having means that are of low cost and effective for eliminating any proliferation of bacteria, germs, or microbes on the evaporator and in its immediate environment, and consequently avoiding any risk of contaminating foodstuffs or goods conserved inside the cold sales cabinet.

It is known that defrosting can be performed, i.e. molecules of water in solid form can be melted to form molecules of water in liquid form, by using energy which is dissipated in the form of microwaves. For example, document GB-2 278 668 discloses a refrigerator in which the evaporator is defrosted by microwave type radiation. The evaporator and the microwave source are placed in a compartment of the refrigerator which is separated from the food by a screen which prevents the microwaves from reaching the food. The water which results from melting the frost formed on the evaporator is collected in a trough placed in the compartment.

That is the closest document although it does not relate to a cold cabinet of the type of the invention since it does not have means for circulating a flow of air. In the present invention, air circulation is very important or even essential in that it is circulating air which conveys low temperature and causes accelerated formation of frost on the evaporator.

The present invention seeks to provide a cold cabinet with forced air circulation in which the defrosting of the evaporator by microwaves gives rise neither to a rise in the temperature of the air curtain nor to a large amount of energy being consumed.

To reduce energy consumption, the present invention provides means for continuously removing water from the compartment containing microwaves. By removing the water, the quantity of energy required for defrosting purposes is reduced, since the microwaves no longer serve to heat that water and are therefore constrained to cause the frost on the evaporator to melt directly. Microwaves have a tendency to heat liquid water first and to heat solid water only subsequently. By removing the liquid water from the compartment or enclosure as it is formed, the microwaves do not have the chance of dissipating therein, and as a consequence there is a saving in radiation and thus in energy, giving rise to operation that is less expensive and faster.

If the water is not removed immediately as it forms, microwave defrosting means are found to be practically useless in terms of melting the frost that forms on the fins.

In another embodiment, the removal means consist in the circulation means. The forced air flow takes away a fraction of the liquid water present on the evaporator, removing it from the enclosure by transporting it in the air.

In a variant or in combination, the removal means comprise at least one orifice formed in the bottom wall of the enclosure. The water flows along the fins of the evaporator and falls under gravity. It is then collected in a metal receptacle and removed to outside the enclosure. Water preferably passes through the bottom wall of the enclosure subjected to the radiation via one or more orifices, a grid, or a perforated sheath, with the open section being selected as a function of the nominal frequency of the generator so as to constitute a wave trap. This passage can be accelerated by slopes converging on the evacuation orifices, where such slopes are conferred on said bottom wall by construction.

The evaporator, or at least its active portion, is contained in a microwave-proof enclosure so that the microwaves are reflected on the walls of said enclosure and release their energy firstly to the ice or frost that they cause to melt. A waveguide, preferably fitted with deflectors, serves to direct the waves onto the fins of the evaporator. It is also possible to use wave stirring means for directing or distributing the waves into preferred zones or directions. In a preferred embodiment, at least two of the walls are made in the form of perforated sheets of grids having openings of dimensions that are large enough to allow a transverse flow of air to pass through the enclosure and small enough to prevent microwave radiation escaping out from the enclosure. In an alternative embodiment of cabinets of the invention, removable partitions are installed which can be solid or partially perforated, said partitions being automatically retracted or folded away during the short periods in which the microwave generator(s) is/are in operation.

In the preferred embodiment, it will be understood that it is appropriate to make the waveguides in such a manner that the waves are directed exclusively or at least preferentially towards the evaporator, or indeed towards the zone of said evaporator which is the most subject to frosting and icing phenomena, i.e. the zone where the forced air comes into contact with said element. It is also possible to use surface waveguides placed on the outside surfaces of all or some of the fins of the evaporator. These surface waveguides are coupled to the microwave generator and made of a dielectric material whose dielectric constant is close to that of frost and whose thermal conductivity is close to that of copper; these two characteristics are advantageous: the first makes it possible to obtain good propagation of waves between the surface waveguides and the layer of frost while the second makes it possible to ensure that the surface waveguides do not act as insulators reducing the heat exchange efficiency between the evaporator and the flow of air. To obtain both of these characteristics simultaneously in spite of them being, a priori, contradictory, the surface waveguides are made of a material belonging to the family of polymers or resins doped by including particles of non-magnetic metal.

In any event, the spacing between the fins constituting the heat exchange surface of the evaporator is selected in such a manner that said spacing optimizes the passage of microwaves between two adjacent fins, i.e. the spacing should be greater than 5 mm, and in such a manner that said spacing makes it possible to obtain a large heat exchange area between the evaporator and the air, i.e. a spacing of less than 10 mm. In preferred manner, the evaporator fitted to a cold sales cabinet of the invention is thus provided with fins at a spacing lying in the range 5 mm to 10 mm.

The evaporator can be provided with a plurality of long fins projecting significantly beyond the alignment constituted by the ends of standard fins. Under such circumstances, the spacing between two long fins should be selected so that said spacing enables good microwave penetration between a long fin and its neighbors of the same category (i.e. more than 5 mm), while the spacing between standard fins is selected in such a manner that said spacing (selected to be less than 5 mm) is not compatible or is poorly compatible with microwaves penetrating into the gaps between the standard fins.

Other advantages and characteristics of the invention will appear on reading the following description of a preferred embodiment of the invention given by way of indication and from the accompanying drawings, in which.

Figure 1:
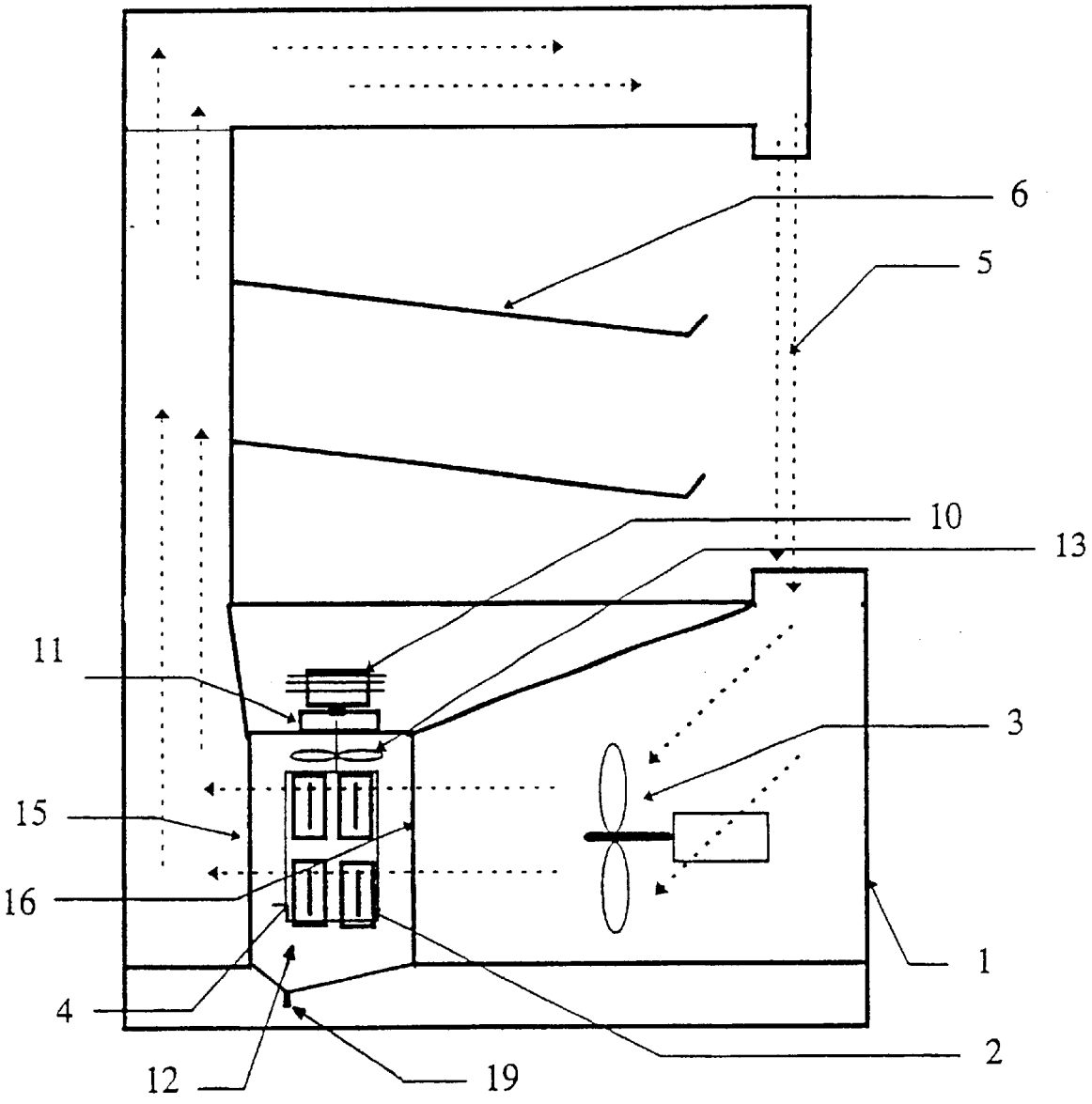
FIG. 1 is an overall section view of a vertical cold cabinet of the invention.
Figure 2:
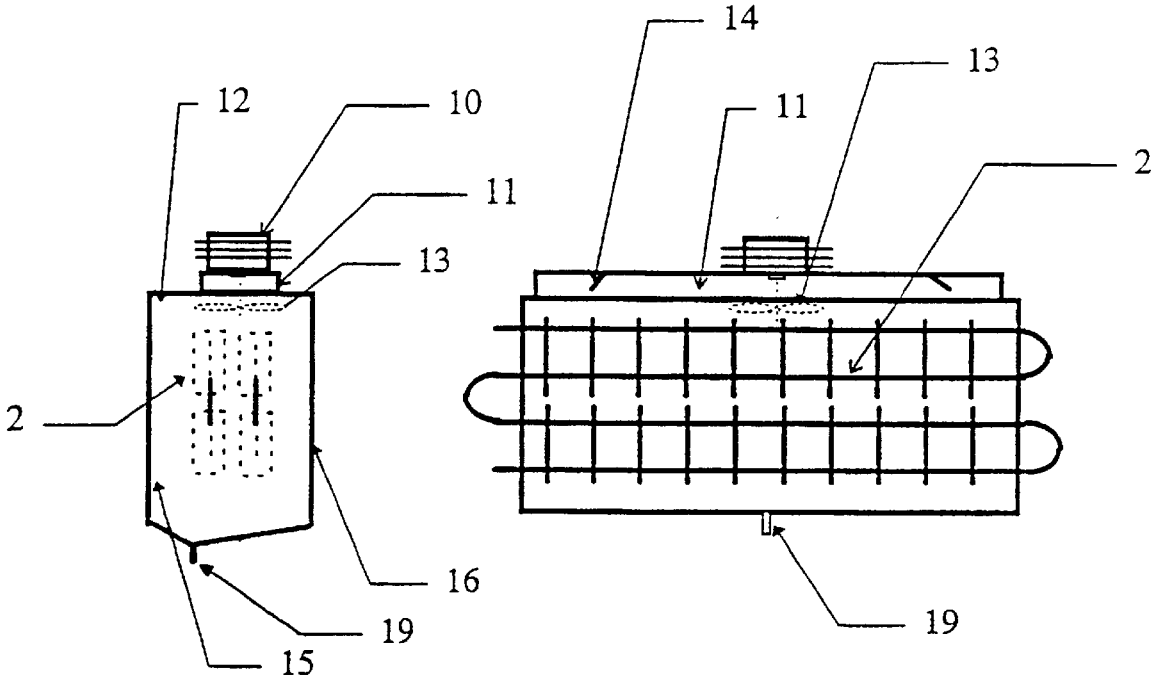
FIG. 2 is a front view and a side view of an evaporator enclosed in an enclosure that is impermeable to microwaves and permeable to air, and that is fitted with a microwave generator.

In FIG. 1, it can be seen that a cabinet of the invention, like a presently-available cabinet, comprises bodywork 1 and cooling means which can be in the form of one or more evaporators 2 having a flow of air forced therethrough by at least one fan 3. After passing over the evaporator 2 where it is significantly cooled, this air is channeled between the walls of the bodywork 1 and is then delivered to the open front face of the cabinet where it forms an air curtain 5. Goods can be placed in or taken from the cabinet through this air curtain 5, with the goods being supported in the cabinet on shelves 6. It will be observed that a cabinet of the invention can equally well be of the category having an internal refrigerator unit, in which case it has additional components such as a compressor and a condenser, or of the category having an external refrigerator unit, in which case the other elements of the refrigerator unit are located outside the bodywork 1, with the evaporator 2 being connected to said unit via pipes for circulating the refrigerating fluid.

In addition to the elements described above, which elements are included in the state of the art, cold sales cabinets of the invention are fitted with at least one means 10 for emitting energy in the form of microwaves. Such cabinets are characterized in that the evaporator 2 is placed in a zone defined by an enclosure 12 into which the microwave energy emitter means 10 emits microwaves. The enclosure is made in such a manner as to be leakproof for microwaves.

In preferred manner, the microwave energy emitter means are constituted by at least one microwave generator, commonly known as a "magnetron". The magnetron 10 transmits its energy via an antenna into a waveguide 11. The waveguide opens out into an enclosure 12 containing all or part of the evaporator 2. To enhance uniform distribution and diffusion of microwaves inside the enclosure 12 or within a preferred zone of the enclosure 12, it is advantageous to use a wave stirrer 13 and/or wave detectors 14 forming part of the means for emitting and distributing microwave energy inside the enclosure 12. In addition, it is possible to provide or all or some of the outside surfaces of the fins of the evaporator 2 with surface waveguides 4 serving to convey microwave radiation to preferred zones of frost formation. Like the fins they cover in full or in part, these surface waveguides are thin. The surface waveguides 24 are constituted by one or more layers of dielectric material, said dielectric material having a dielectric constant close to that of frost and thermal conductivity close to that of copper, and is preferably selected from the family of polymer or resin materials doped by the inclusion of particles of non-ferromagnetic metal. Thus, the surface waveguides disturb heat exchange little or not at all and they serve to optimize diffusion of microwaves to the frost whose formation is countered in particularly fast and effective manner and whose thickness can be maintained at an optimum value.

One of the advantageous characteristics of the enclosure 12 is that it is simultaneously leakproof to microwaves and not leakproof to air. The enclosure 12 is made in such a manner that microwave energy is confined in its inside volume and has no means of escaping therefrom, while the flow of air driven by the fan 3 can pass through the enclosure while suffering only a small amount of head loss. This pair of characteristics is obtained by providing the said enclosure 12 with at least two opposite metal walls 15 and 16 that are pierced by holes of small diameter (diameter of a few millimeters if microwave generators are used that operate at a frequency of about 2450 MHz), with the holes being placed extremely close together so that the flow section for air is equal to at least 50% of the total surface area. The enclosure 12 is provided with two opposite walls 15 and 16 that are constituted completely or for the most part by perforated metal sheets or by open metal grids in which the plane openings all have at least one dimension of less than 5 mm. In any event, various combinations of sheet thickness, of slot width, or hole diameter can be selected, and stacks of perforated sheets and/or grids can be made so as to achieve effective wave trapping simultaneously with head losses that are as small as possible. Advantageously, these perforated walls 15, 16 or at least the wall 16 situated downstream from the evaporator in the direction in which air circulates through the enclosure is/are in thermal contact with the evaporator.

In any event, the enclosure 12 has at least one orifice 19 in its bottom portion allowing water to flow under gravity out from the enclosure. This orifice 12 is provided with a wave trap or is of sufficiently small size to prevent any radiation passing out from the enclosure 12.

In an alternative construction, the two opposite walls 15 and 16 for allowing air to flow through are removable walls in the form of sliding hatches or flaps that are made out of metal sheets and that are solid or partially perforated. These opening/closing devices are motor-driven and controlled by an automatic device so as to take up the closed position while microwave energy is being emitted and an open position for the rest of the time. This disposition allows air to pass completely freely through the enclosure 12 during periods when the microwave energy emitter means 10 are not in operation, said walls 15, 16 naturally being closed or folded down during periods in which the means 10 are in operation.

It can be seen that the air circuit inside a cold sales cabinet of the invention is implemented in such a manner that air is set into motion by at least one fan 3, passes through a perforated or removable wall 16 of the enclosure 12, passes over at least one evaporator 2, passes through a second perforated or removable wall 15 of the enclosure 12, and is then guided inside the bodywork 1 to a face which is constantly or periodically open and along which it travels in the form of a curtain of air 15 prior to returning to the fan(s) 3. This refrigerated air circuit in contact with the evaporator 2 makes it possible to keep the foodstuffs contained on the shelves 12 at a constant refrigerated temperature. Frost deposition on the evaporator, an inevitable phenomenon which in the prior art has the consequence of considerably reducing the flow rate of air, is now countered continuously or periodically by operating the means 10 for emitting microwave energy into the enclosure 12. Advantageously, the microwave energy is preferably emitted or guided towards that portion of the evaporator which receives air coming from the air curtain 5 after it has passed through the fan. It is in this zone that frost builds up the most. If the microwave energy emitter means 10 are caused to operate periodically, it is advantageous to control operation thereof either as a function of measuring the flow rate of air after the air has passed through the evaporator 2, or of measuring temperature, or of measuring the humidity of the flow of air, or of detecting frost on the evaporator 2, or indeed some combination of these techniques. In any event, the microwave radiation is directed and delivered by actuating the microwave energy emitter means 10 which are coupled to means for directing or distributing microwave energy within the enclosure 12, said means for directing or distributing microwave energy within the enclosure 12 being constituted by at least one waveguide 11 and/or wave stirrer 13 and/or deflectors 14 and/or surface waveguides 4 or by any combination of all or some of these elements. The means 10 for emitting microwave radiation are actuated cyclically or continuously in such a manner as to have the effect of maintaining a layer of frost on at least a portion of the outside surface of the evaporator at a thickness which is small and optimum. To obtain best performance, the thickness of said layer of frost should lie in the range zero thickness to a thickness of 1 mm.

Figure 3:
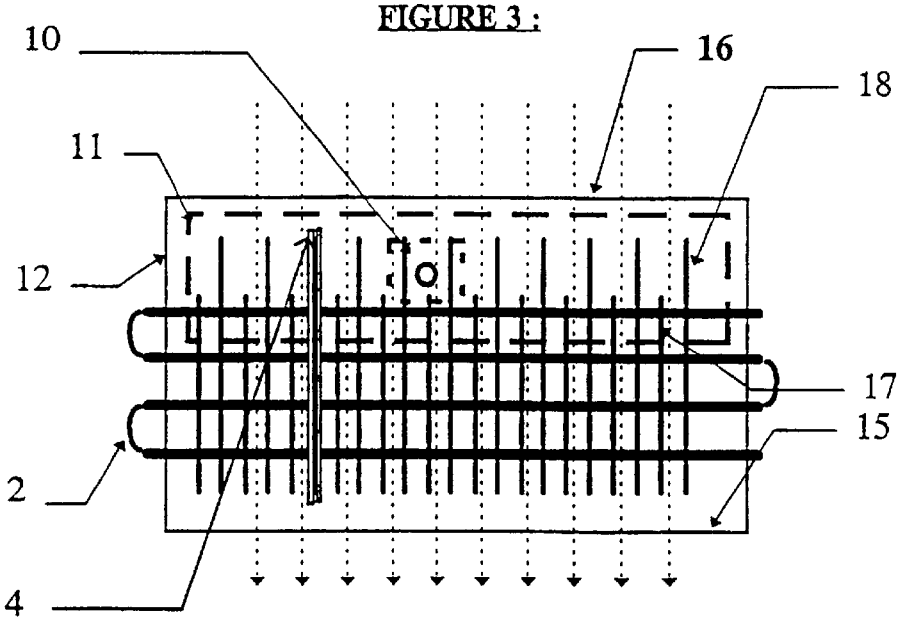
FIG. 3 is a view from beneath of a variant evaporator placed in an enclosure fitted to a cold sales cabinet of the invention.

FIG. 3 shows an arrangement for improving the thermal efficiency of cabinets of the invention. It consists in causing most of the frost to deposit on special fins 18 that are longer than the fins 17 of the evaporator 2. This projection is located on the front face of the evaporator 2, i.e. the face facing towards the wall 16 through which the flow of air driven by the fan 3 penetrates into the enclosure 12. Since the extensions on the fins 18 are the first cold surfaces that are encountered by the flow of air, it will be understood that frost forms preferentially on said extensions. Since the fins 18 are spaced more widely than the fins 17, obstruction phenomena are delayed; in addition, microwave energy is directed preferentially into the zone where said long fins 18 project relative to the ends of the ordinary fins 17.

It is therefore advantageous to make evaporators 2 having a series of fins 18 longer than the ordinary fins 17 and to ensure that the microwave radiation is emitted preferentially inside the enclosure 12 towards the zone where the fins 18 project beyond the end of the fins 17. Furthermore, the zone where the fins 18 project from the fins 17 and the zone where the microwave radiation is preferably emitted face towards the wall 16 of the enclosure 12 through which the forced air flow penetrates into said enclosure 12.

Figure 4:
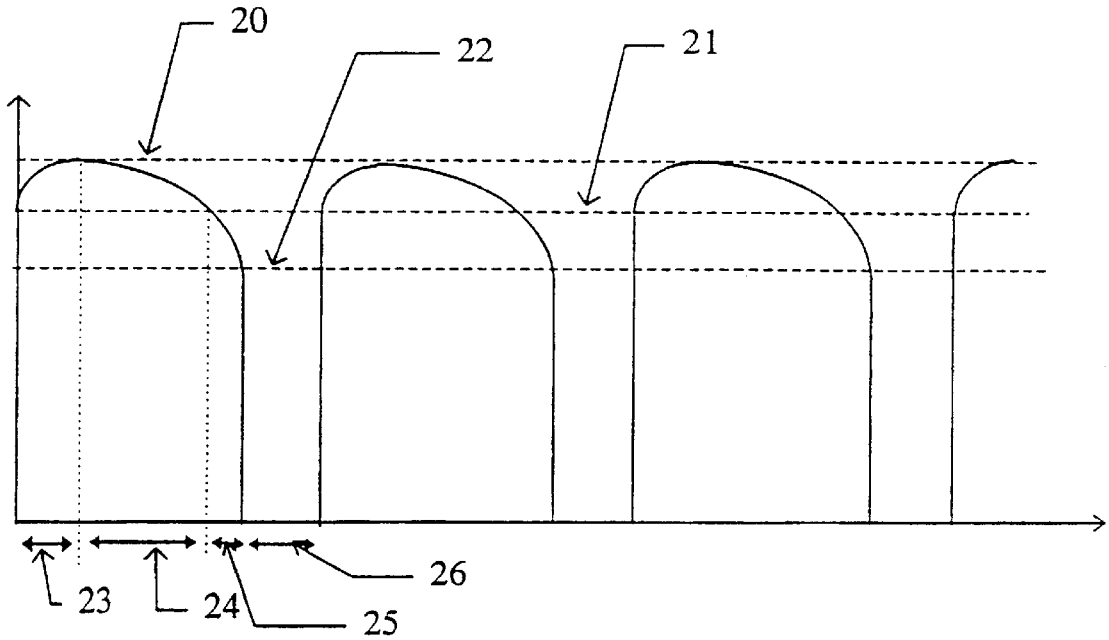
FIG. 4 is a diagram showing how a cold sales cabinet of the invention fitted with a prior art defrosting device would operate.

FIG. 4 is a diagram showing the operation of a cold sales cabinet fitted with a prior art evaporator defrosting device. In this diagram, cooling power is plotted up the vertical axis while time is plotted along the horizontal axis. It can be seen that operation is based on repeating identical cycles. In each cycle, initially cooling power increases because of the appearance of a fine film of frost on the fins of the evaporator. During the first period 23, power rises from an initial level 21 to a maximum level 20. During the following period 24, the formation of frost or ice has the effect of building up an insulating layer and of beginning to reduce the air flow section between the fins, thereby countering the beneficial effects of the initial formation of frost, such that the cooling power drops back down to the initial level 21. These phenomena of insulation and of obstruction then continue (25) until cooling power reaches a minimum level 22 which is deemed to be unacceptable for proper operation of the cold sales cabinet and conservation of foodstuffs. It is then necessary to start a defrosting sequence 26 during which the cooling power is zero or even negative: the air flow is no longer cooled, and in most known solutions, it is indeed heated. It is only after the evaporator has been completely defrosted that it is possible to start a new cycle, identical to that described above. In general, these cycles are of a duration lying in the range 1 hour to 5 hours. It can be seen that that mode of operation has drawbacks associated with the inadequacies of presently-proposed defrosting solutions, the mean cooling power delivered in that mode of operation over one day of operation is about 70% the initial level 21, and about 60% the maximum level 20.

Figure 5:
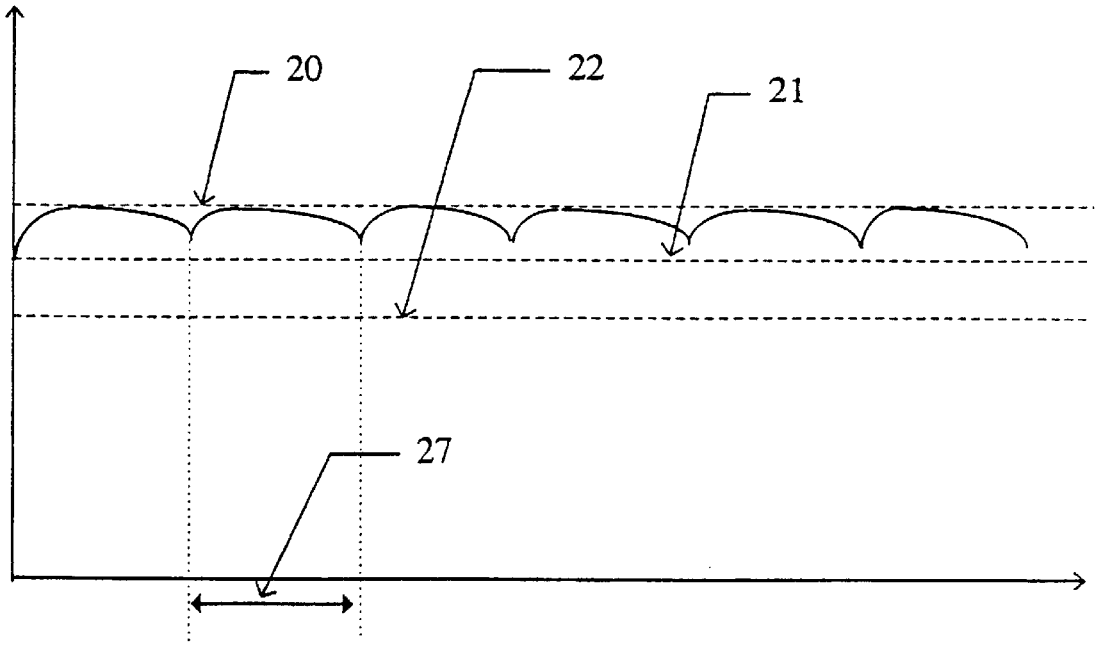
FIG. 5 is a diagram showing how a cold sales cabinet of the invention does, in fact, operate.

FIG. 5 uses the same presentation as FIG. 4 to show how a cold sales cabinet of the invention operates. The cycle starts identically, i.e. a fine layer of frost is allowed to form on the surface of the evaporator. Once maximum power 20 has been reached, the microwave energy emitter means are started. This transmission is provided in a quantity such that the layer of frost is maintained at a thickness in the range zero or nearly zero and its optimum value, where said optimum value has been found to be close to and less than 1 mm. Regulation can be in progressive mode or in on/off mode, and it can be controlled from temperature sensors, flow rate sensors, humidity sensors, frost detectors, or any combination of these various means. The generation of the cycle 27 is a function of the sensitivity and the settings of the regulation means. It is adapted so that cooling power lies continuously between initial power 21 and maximum power 20 without ever dropping to the minimum level 22. It will be understood that the invention makes it possible to provide cold sales cabinets whose refrigeration performance in continuous operation over an entire day are of the same order as the initial power 21 or indeed significantly greater than that, approaching the maximum power 20. For equal bodywork, evaporator, and fan dimensions, the increase in performance achieved by the device using microwave radiation to limit frosting phenomena on evaporators of cold cabinets thus amounts to at least 20% compared with the highest performance devices included in the prior art.

It will also be observed that the function of defrosting and maintaining a layer of frost of optimum thickness is not the only function of the microwaves emitted towards the evaporator and its immediate surroundings. It is possible to decide to emit microwave energy over a length of time that is considerably longer than that required for melting all of the solid water present on the evaporator 2 and in the vicinity of said evaporator 2. Under such circumstances, and without interfering with the operation of the evaporator 2, significant heating will be obtained of all dipolar cells and molecules situated in the zone in which the radiation propagates; in particular, bacteria, germs, or microbes present in the air and/or the water can easily and quickly be raised to temperatures in excess of 60° C. or even, where necessary, temperatures in excess of 100° C. In particular, it is possible to decide to proceed once every 24 hours with one long cycle during which microwaves are emitted for half an hour so as to be sure that no living organism remains on the evaporator 2 or in the environment close to the evaporator, nor in the air driven by the fans and brought into contact with the food, which is in contrast to that which takes place in cold sales cabinets using prior art defrosting devices. Cabinets of the invention thus advantageously regulate the microwave energy transmission sequences as performed by the means 10 at a given power level, to operate over various durations, including a duration enabling said means to sterilize the evaporator 2, its immediate surroundings, and the air circulated by the fan 3, thereby constituting a significant and original characteristic of cabinets of the invention.

Naturally, the above description is given merely by way of indication and other embodiments of cold sales cabinets could be selected, in particular other embodiments of evaporators and enclosures subjected to microwave radiation, without thereby going beyond the ambit of the present invention.

What is claimed is:

1. A cold sales cabinet, characterized in that it comprises cooling means (2) and forced air circulation means (3) for causing a flow of air to circulate through the cooling means to cool the inside of the cabinet, the cooling means being placed in a zone (12) suitable for being subjected to microwave radiation emitted by microwave energy emitter means (10), the zone (12) being defined by an enclosure that is proof against microwave radiation but not airtight, removal means being provided to take the water that results from the microwave radiation melting the frost out from the microwave-proof enclosure.

2. A cold cabinet according to claim 1, in which the removal means are constituted by the forced air circulation means.

3. A cold cabinet according to claim 1, in which the removal means comprise at least one orifice (19) formed through a wall of the enclosure.

4. A cold sales cabinet, comprising:

cooling means (2); and forced air circulation means (3) for causing a flow of air to circulate through the cooling means to cool the inside of the cabinet;

the cooling means being placed in a zone (12) suitable for being subjected to microwave radiation emitted by microwave energy emitter means (10), the zone (12) being defined by an enclosure that is proof against microwave radiation but not airtight, removal means being provided to take the water that results from the microwave radiation melting the frost out from the microwave-proof enclosure, wherein the removal means comprise at least one orifice (19) formed through a wall of the enclosure, and wherein the orifice (19) is provided with a wave trap preventing any microwave radiation passing therethrough.

5. A cold sales cabinet according to claim 1, characterized in that the microwave energy emitter means are suitable for maintaining a layer of frost on the cooling means having a thickness of about 0 to 1 mm.

6. A cold sales cabinet comprsing:

cooling means (2); and forced air circulation means (3) for causing a flow of air to circulate through the cooling means to cool the inside of the cabinet;

the cooling means being placed in a zone (12) suitable for being subjected to microwave radiation emitted by microwave energy emitter means (10), the zone (12) being defined by an enclosure that is proof against microwave radiation but not airtight, removal means being provided to take the water that results from the microwave radiation melting the frost out from the microwave-proof enclosure, wherein the microwave energy emitter means (10) are coupled with means for directing or distributing microwave energy within the enclosure (12), said means for directing or distributing microwave energy within the enclosure (12) being constituted by at least waveguide (11), and/or a wave stirrer (13), and/or deflectors (14), and/or surface waveguides (4), or by any combination of all or some of these elements.

7. A cold sales cabinet according to claim 6, characterized in that the surface waveguides are made of a material constituted by one or more layers of dielectric material, said dielectric material presenting a dielectric constant close to that of frost and thermal conductivity close to that of copper, and being selected from the family of resin or polymer materials doped by inclusion of particles of non-ferromagnetic metal.

8. A cold sales cabinet comprising.

cooling means (2); and forced air circulation means (3) for causing a flow of air to circulate through the cooling means to cool the inside of the cabinet;

the cooling means being placed in a zone (12) suitable for being subjected to microwave radiation emitted by microwave energy emitter means (10), the zone (12) being defined by an enclosure that is proof against microwave radiation but not airtight, removal means being provided to take the water that results from the microwave radiation melting the frost out from the microwave-proof enclosure, wherein the enclosure (12) has at least tow perforated metal grids or perforated metal sheets (15, 16) places on two opposite walls of said enclosure (12).

9. A cold sales cabinet according to claim 1 comprising:

cooling means (2); and forced air circulation means (3) for causing a flow of air to circulate through the cooling means to cool the inside of the cabinet;

the cooling means being placed in a zone (12) suitable for being subjected to microwave radiation emitted by microwave energy emitter means (10), the zone (12) being defined by an enclosure that is proof against microwave radiation but not airtight, removal means being provided to take the water that results from the microwave radiation melting the frost out from the microwave-proof enclosure, wherein the enclosure (12) has opening/closing devices placed on two opposite walls (15, 16) of the enclosure (12) and actuatable in such a manner as to be in a closed position during stages in which microwave energy is being emitted into the inside of the enclosure, and in an open position the rest of the time.

10. A cold sales cabinet comprising:

means (2); and forced air circulation means (3) for causing a flow of air to circulate through the cooling means to cool the inside of the cabinet;

the cooling means being placed in a zone (12) suitable for being subjected to microwave radiation emitted by microwave energy emitter means (10), the zone (12) being defined by an enclosure that is proof against microwave radiation but not airtight, removal means being provided to take the water that results from the microwave radiation melting the frost out from the microwave-proof enclosure, wherein the cooling means (2) include a series of fins (18) longer than ordinary fins (17), and in that the microwave radiation is preferentially emitted inside the enclosure (12) toward the zone where the long fins (18) project beyond the ends of the short fins (17), said zone facing towards the wall (16) of the enclosure (12) through which the forced air penetrates into said enclosure.

11. A cold sales cabinet according to claim 1, characterized in that it includes means for regulating microwave energy transmission sequences to a power level and a duration such as to enable the microwaves to perform the function of sterilizing the evaporator (2), its immediate surroundings, and the air circulated by the fan (3).

12. A cold sales cabinet according to claim 1, characterized in that the microwave energy emitter means (10) operates periodically, operation thereof being servo-controlled either to a measurement of the flow rate of air after it has passed over the evaporator (2), or to a measure of temperature, or to a measure of the humidity of the air flow, or to detecting frost on the evaporator (2), or indeed to any combination of these techniques.

* * * * *